US006183157B1

(12) United States Patent
Brown et al.

(10) Patent No.: US 6,183,157 B1
(45) Date of Patent: Feb. 6, 2001

(54) METHOD AND APPARATUS FOR SECURING AN ELECTRONIC DEVICE TO A LOOSE-LEAF SUPPORT ASSEMBLY

(75) Inventors: Jeffery O. Brown, North Logan; Gary E. Hogge, Kaysville, both of UT (US)

(73) Assignee: Franklin Covey Co., Salt Lake City, UT (US)

( * ) Notice: Under 35 U.S.C. 154(b), the term of this patent shall be extended for 0 days.

(21) Appl. No.: 09/123,551

(22) Filed: Jul. 28, 1998

(51) Int. Cl.[7] ..... B42D 13/00; B65D 85/30

(52) U.S. Cl. ..... 402/79; 402/80 P; 402/79; 402/4; 402/80 R; 281/38; 281/37; 206/488; 206/311

(58) Field of Search ..... 402/79, 4, 80; 281/38, 37; 206/488, 311

(56) References Cited

U.S. PATENT DOCUMENTS

| | | | | |
|---|---|---|---|---|
| D. 343,187 | | 1/1994 | Webb et al. . | |
| D. 345,757 | | 4/1994 | Webb et al. . | |
| 4,832,191 | | 5/1989 | Gerver et al. . | |
| 4,884,691 | * | 12/1989 | Behrens et al. | 206/444 |
| 4,918,632 | | 4/1990 | York . | |
| 4,973,184 | * | 11/1990 | La Salle | 281/31 X |
| 5,058,736 | * | 10/1991 | Bedo | 281/31 |
| 5,150,787 | * | 9/1992 | Bird et al. | 206/329 |
| 5,159,533 | * | 10/1992 | Kuang | 361/391 |
| 5,209,592 | | 5/1993 | Bedol . | |
| 5,232,301 | | 8/1993 | Bianco . | |
| 5,340,156 | * | 8/1994 | Bianco | 281/37 |
| 5,358,135 | * | 10/1994 | Robbins et al. | 220/338 |
| 5,402,322 | * | 3/1995 | Kunder et al. | 361/679 |
| 5,476,336 | * | 12/1995 | Osieki et al. | 402/79 |
| 5,597,256 | * | 1/1997 | Burton et al. | 281/38 |

* cited by examiner

*Primary Examiner*—A. L. Wellington
*Assistant Examiner*—Alisa L. Thurston
(74) *Attorney, Agent, or Firm*—Trask Britt

(57) ABSTRACT

An apparatus for attaching an electronic device to a loose-leaf support assembly. The attachment apparatus includes a housing, a receptacle defined in the housing, a capture element adjacent the receptacle, and an attachment member. The capture element includes a retaining lip at one edge of the receptacle and a resilient engagement clip adjacent another edge of the receptacle. The capture element retains an electronic device within the receptacle. The attachment apparatus may also include one or more retaining slots along peripheral edges thereof to secure an attachment member to the housing. The attachment apparatus may also include one or more access slots formed therethrough so as to facilitate communication of an electronic device secured to the attachment apparatus with external electronic devices.

33 Claims, 9 Drawing Sheets

METHOD AND APPARATUS FOR SECURING AN ELECTRONIC DEVICE TO A LOOSE-LEAF SUPPORT ASSEMBLY

BACKGROUND OF THE INVENTION

1. Field of the Invention

The present invention relates to apparatus for securing electronic devices into notebooks. Particularly, the present invention relates to apparatus for releasably securing a hand-held electronic device to the rings of a binder-type notebook. More specifically, the present invention relates to apparatus for securing a hand-held electronic device within the notebook of a time management or other planning-type organizer system.

2. Background of Related Art

Due to the ever-decreasing size of electronic devices and the ever-increasing use of notebooks which include time management or other planning systems, various apparatus have been developed to make small electronic devices, such as calculators, readily accessible to the users of such notebooks and in conjunction with information contained within the notebook.

Some of these apparatus secure a calculator to the rings of binder-type notebooks. These apparatus typically include integral calculators and small, circular apertures disposed along an edge thereof to facilitate securing of the apparatus to the rings of a binder. Since the calculators are an integral part of each of these apparatus, they may not be removed therefrom. Thus, the calculators of these apparatus cannot be accessed concurrently with information from any pages of the notebook that are not adjacent to these apparatus. Moreover, such apparatus may not be employed to secure more than one type of electronic device to a notebook. The small, circular apertures of these apparatus are also somewhat undesirable, as they may only be used in notebooks with specific numbers of rings that are laterally spaced apart discrete distances from one another. Apparatus exemplary of this configuration are disclosed in U.S. Pat. No. Des. 345,757 ("the '757 patent"), which issued to Webb et al. on Apr. 5, 1994; U.S. Pat. No. Des. 343,187 ("the '187 patent"), which issued to Webb et al. on Jan. 11, 1994; and U.S. Pat. No. 5,209,592 ("the '592 patent"), which issued to Bedol on May 11, 1993.

U.S. Pat. No. 4,918,632 ("the '632 patent"), which issued to York on Apr. 17, 1990, discloses a notebook-type computer that includes a housing that may be secured to the rings of a binder-type notebook. As with the calculators discussed above, the computer is integrated within the housing. Thus, the housing may not be used to secure other electronic devices to a notebook. The housing also includes small, circular apertures along the top of the computer for securing the electronic device to the rings of a binder-type notebook. Thus, the housing may only be secured to notebooks of a limited size and having a limited number of rings which are laterally-spaced discrete distances from one another.

An apparatus that may be employed to secure a variety of hand-held electronic devices within a variety of binder-type notebooks is disclosed in U.S. Pat. No. 5,597,256 ("the '256 patent"), which issued to Burton et al. on Jan. 28, 1997. The apparatus of the '256 patent is an insert that includes a flat member to which a hand-held electronic device, such as a calculator, may be secured by attaching one member of complementary hook and loop materials to the flat member and the other hook or loop material member to the back of the electronic device. The use of hook and loop materials to secure the electronic device to the flat member is, however, somewhat undesirable since, over time, the hook material tends to gather lint, which may reduce the affinity of the hook and loop materials for one another. Moreover, the mutual affinity with which the hook and loop materials secure the electronic device to the flat member may not be adequate to retain the electronic device on the flat member if the notebook that holds the insert is dropped.

Another insert for securing hand-held electronic devices into binder-type notebooks is marketed by Franklin Covey Co., the assignee of the present invention. That insert removably retains the electronic device by means of small, rigid tabs disposed about the edges of a receptacle thereof. These tabs insert into a seam or indentation along the periphery of the housing of the electronic device. Due to potential variations in the size of the seams of the electronic device relative to the tab thickness required to adequately retain the electronic device within the receptacle of the insert, the dimensional tolerances of that insert are undesirably small. The retaining tabs of that insert are further undesirable in that they will only accommodate electronic devices of a very specific size and shape incorporating a seam or other indentation of a specific size and in a specific location. Moreover, when the hand-held electronic device is disposed within that insert, communication with any external electronic equipment is precluded, due to obstruction of communication ports on the electronic device by the insert body.

Other apparatus secure calculators or other electronic devices to the rigid cover of a notebook or any other book by means of mounts, sleeves, or clamps. An exemplary apparatus of this type is disclosed in U.S. Pat. No. 4,832,191 ("the '191 patent"), which issued to Gerver et al. on May 23, 1989. The apparatus of the '191 patent includes a sleeve that envelops a substantial portion of the rigid cover. A flap, which holds and exposes the display and keys of a calculator, is hingedly attached to the sleeve. The design of the device of the '191 patent is somewhat undesirable, however, in that the sleeve may slide along the rigid cover of the notebook and may, therefore, not adequately secure the calculator thereto. The sleeve may be further undesirable from an aesthetic standpoint, since it is exposed on the exterior of the rigid cover of a notebook or other book.

U.S. Pat. No. 5,232,301 ("the '301 patent"), which issued to Bianco on Aug. 3, 1993, discloses a binder which includes an apparatus for securing an electronic device, such as a calculator, thereto. The apparatus is permanently secured to the cover of the binder by a mounting bracket. A frame, which is secured to the mounting bracket by a hinge, is rotatably mounted to a slipcase, in which the electronic device may be removably disposed. This arrangement facilitates use of the calculator while the binder is closed or open, as well as access to pages that are bound to the rings of the binder. The design of the apparatus of the '301 patent is somewhat undesirable, however, in that the electronic device must be removed therefrom in order to communicate with any external devices, such as printers, computers, or other electronic devices. Moreover, the mounting bracket of the mechanism of the '301 patent is partially exposed to the exterior of the binder cover, making it somewhat undesirable from an aesthetic standpoint. Furthermore, since the apparatus is permanently mounted to the binder, it may not be removed from the binder when removal is desired or used in conjunction with another notebook.

Thus, an apparatus is needed for securing an electronic device to the retainer elements of loose-leaf support assemblies that securely, yet removably retains the electronic device, which is itself removable from the support assembly, and which facilitates communication between the electronic device and external equipment as the electronic device is retained by the support assembly. An apparatus is also needed which enables securement of electronic devices to a variety of support assemblies that have different numbers of retaining elements or retaining elements that are laterally spaced apart different distances from each other.

SUMMARY OF THE INVENTION

The attachment apparatus and methods of the present invention address the foregoing needs.

The present invention includes an attachment apparatus for securing an electronic device to the retaining elements of a loose-leaf support assembly, such as a time management notebook. The securing apparatus includes a housing with a receptacle formed therein that is adapted to receive an electronic device, a capture element disposed adjacent at least one edge of the receptacle, and an attachment member disposed along a peripheral edge of the housing and configured for engagement by the retaining elements, such as ring components, of the support assembly.

The capture element may include a lip which extends at least partially along at least one edge of the receptacle. Upon insertion of an electronic device into the receptacle, the lip engages a peripheral edge of the electronic device in order to retain the edge of the electronic device within the receptacle. The edge of the receptacle that comprises the lip may include a slightly concave (with respect to the receptacle) curvature, which facilitates the insertion of differently sized (due to dimensional tolerances) electronic devices into and removal of same from the receptacle.

The capture element also includes an engagement clip adjacent another edge of the receptacle. The engagement clip is located and configured to releasably engage another peripheral edge of the electronic device disposed within the receptacle. Preferably, the engagement clip resiliently engages the electronic device during disposal and retention of the latter within the receptacle.

The attachment apparatus of the present invention may also include one or more components which facilitate ready access to external communication access features of the electronic device, such as any cable communication ports or infrared communication elements thereof. The securing apparatus may include an access portal for accessing an electronic communication port of the electronic device while the electronic device is disposed within receptacle. Such an access portal may include a cap component disposable thereover, which covers the access portal when access to the communication port of an electronic device is not desired and may, thereby, protect the communication port from damage and environmental contamination. Similarly, a window may be defined through the housing of the apparatus, such as through the engagement clip thereof, to facilitate the transmission of infrared communication signals to and from an infrared communication element of the electronic device.

The attachment member of the apparatus of the present invention includes apertures formed therethrough, each of which is sized to receive a retaining element, such as at least one ring component of a support assembly. Apertures are spaced along the attachment member in a manner which facilitates the securing of the same to the retaining elements of a support assembly. Preferably, at least some of the apertures are somewhat elongated to facilitate engagement of the attachment member by the retaining elements of differently-sized support assemblies or to support assemblies having different numbers or spacings of retaining elements. The housing of the attachment apparatus includes retaining slots formed in one or more peripheral edges thereof, each of which is adapted to removably receive a portion of the attachment member. Preferably, retaining slots are defined in both peripheral side edges of the securing apparatus to facilitate positioning of the attachment member on either side of the attachment apparatus and to thus facilitate variable orientation of the securing apparatus relative to a support assembly to which the securing apparatus may be attached.

Other features of the present invention, as well as the advantages thereof, will become apparent to those of skill in the art through a consideration of the ensuing description, the accompanying drawings, and the appended claims.

DETAILED DESCRIPTION OF THE PREFERRED EMBODIMENTS

Figure 1:
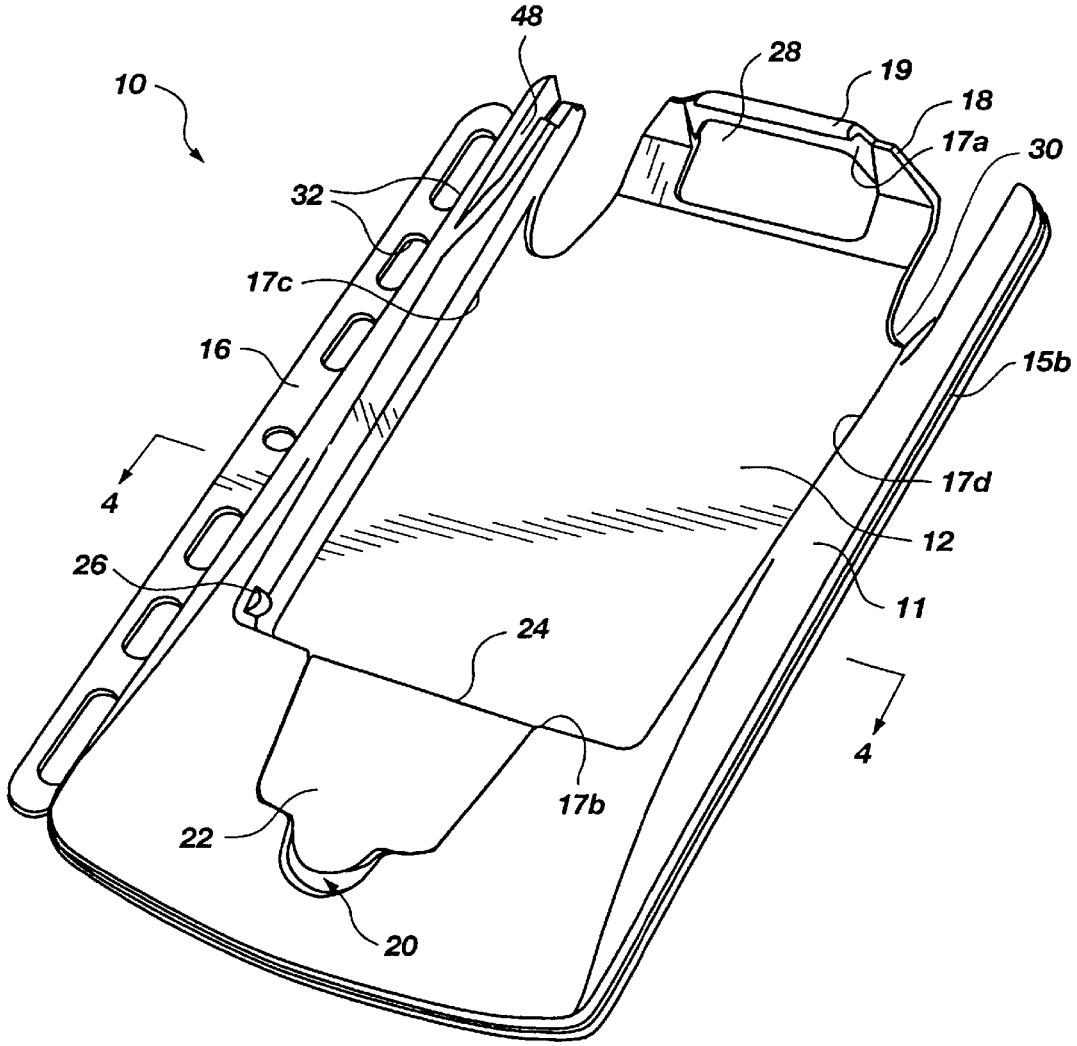
FIG. 1 is a frontal perspective view of an attachment apparatus according to the present invention.
Figure 2:
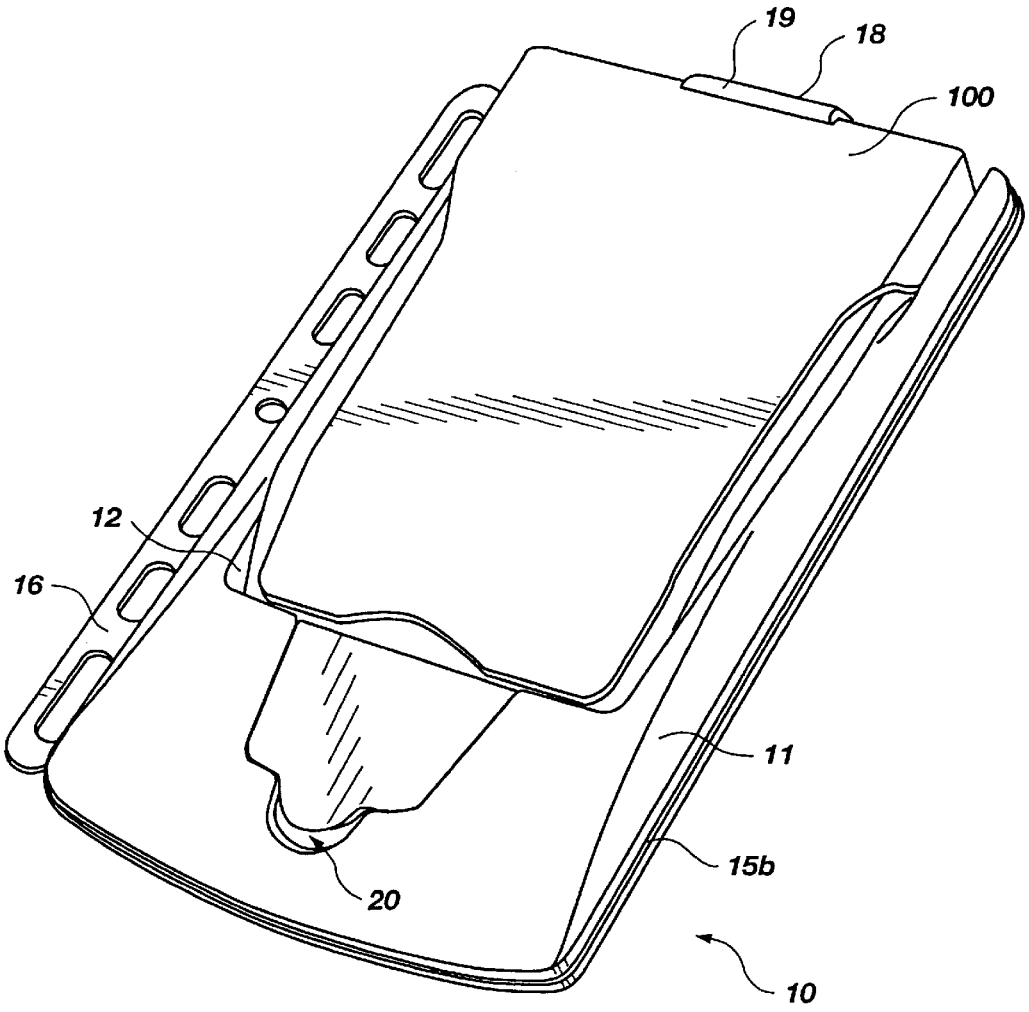
FIG. 2 is a frontal perspective view of the apparatus shown in FIG. 1, and including an electronic device disposed in a receptacle of the apparatus.
Figure 3:
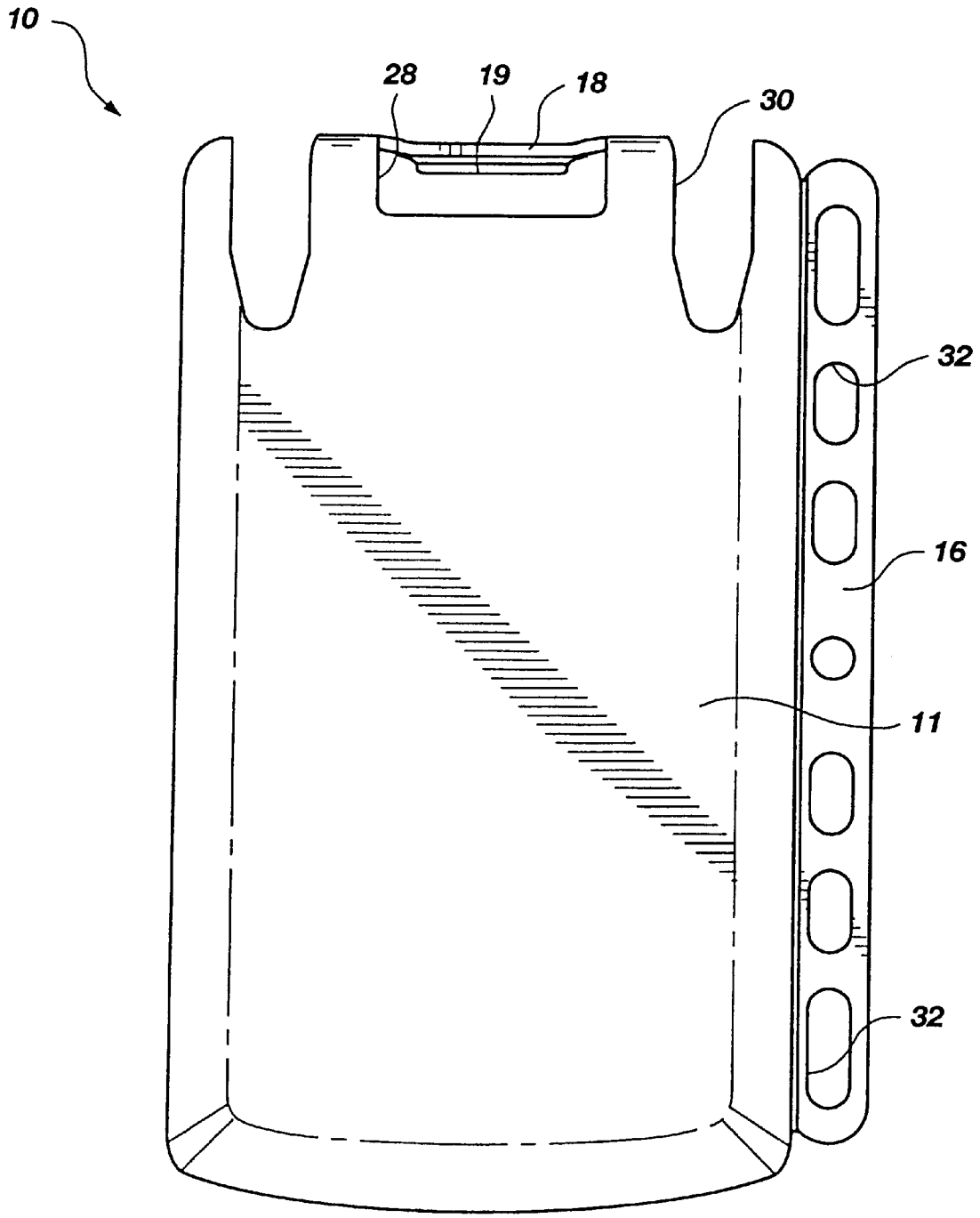
FIG. 3 is a rear plan view of the apparatus of FIG. 1.

With reference to FIGS. 1–3, an attachment apparatus 10 for engaging an electronic device 100, such as a PALMPILOT PERSONAL, PALMPILOT PROFESSIONAL, or PALM III, manufactured by Palm Computing of Mountain View, Calif., and securing the electronic device to the retaining element of a loose-leaf support assembly, which is also referred to simply as a support assembly, is illustrated. Attachment apparatus 10 includes a housing 11 within which a receptacle 12 is formed. A capture element, which preferably includes an engagement clip 18 that is disposed adjacent an edge 17*a* of receptacle 12, and a retaining lip 24 at another, opposing edge 17*b* of receptacle 12 secures the electronic device 100 within receptacle 12. Housing 11 includes one or more retaining slots 15*a* (see FIG. 4), 15*b*, each formed along a peripheral edge thereof. An attachment member 16 may be removably secured to housing 11 by means of retaining slots 15*a*, 15*b*.

With continued reference to FIGS. 2 and 3, attachment apparatus 10 may include an access portal 20, through which a communication port (not shown) of electronic device 100 may be accessed by an adaptor of a communication cable (not shown) while the electronic device is disposed within receptacle 12.

Various types of communication ports that may be accessed through access portal 20 include, without limitation, known communication ports (e.g., the HOTSYNC port of the PALMPILOT PERSONAL, PALMPILOT PROFESSIONAL and PALM III electronic devices and parallel communication ports). Attachment apparatus 10 may also include a window 28 formed through housing 11 located to expose any infrared communication elements 106 (see FIG. 6) of electronic device 100 when received in receptacle 12. Attachment apparatus 10 may also include a stylus insertion slot 30, which facilitates the insertion of a stylus pen (not shown) into a stylus retaining element 104 (see FIG. 6) of electronic device 100.

As shown in FIG. 1, one or more edges 17*c*, 17*d* of receptacle 12 may include recesses 48 that are configured to receive various other features of an electronic device 100, such as flanges on a cover thereof (not shown), and which facilitate the operation of such features while the electronic device 100 is disposed within receptacle 12.

Receptacle 12, which is adapted to receive electronic device 100 (see FIG. 2), includes a capture element, which preferably includes an engagement clip 18 disposed adjacent an edge 17*a* of receptacle 12 and one or more securing tabs 26 disposed along one or more other edges 17*b*, 17*c*, 17*d* of receptacle 12. Securing tabs 26 are configured to engage recesses (not shown) formed in a complementary location of electronic device 100. Securing tabs 26 and engagement clip 18 preferably function to mutually retain an electronic device 100 within receptacle 12. The capture element may also include a retaining lip 24 at an edge 17*b* of receptacle 12.

Figure 4:
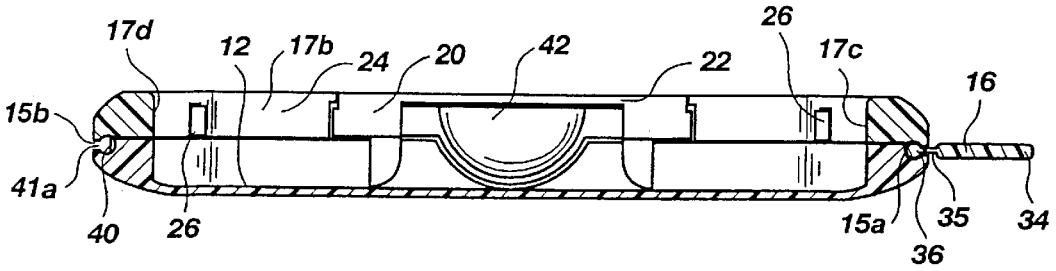
FIG. 4 is a cross-section taken along line 4—4 of FIG. 1, illustrating the lip protruding into the bottom edge of the receptacle and a portion of an access portal which opens into the receptacle.

FIGS. 1 and 4 show retaining lip 24, which may be defined by a slight concave curvature, relative to receptacle 12, from the top to the bottom of edge 17*b*. Retaining lip 24 engages and retains a bottom edge of an electronic device 100 (see FIG. 2) that is disposed within receptacle 12, partially securing electronic device 100 within receptacle 12.

Figure 4A:
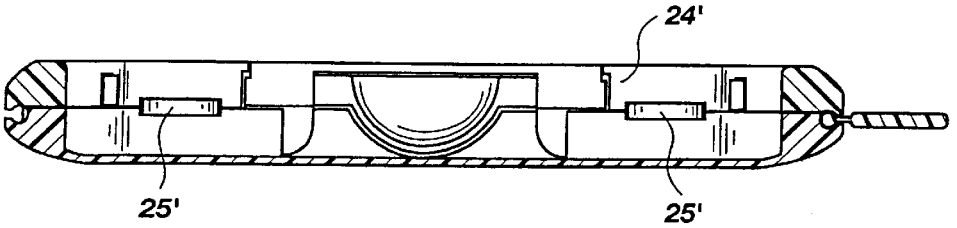
FIGS. 4*a* and 4*b* are cross-sectional views that illustrate variations of the lip.
Figure 4B:
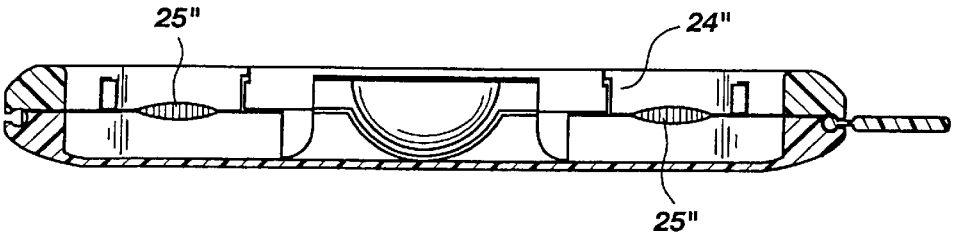

Alternatively, as shown in FIG. 4*a*, a variation of retaining lip 24' includes one or more tabs 25' protruding therefrom. Each tab 25' is insertable into a recess of a peripheral edge of electronic device 100, such as a seam formed in the housing thereof. FIG. 4*b* illustrates another variation of retaining lip 24", which includes a recess 25" configured to receive a protrusion of the housing of electronic device 100.

The position of retaining lip 24 relative to receptacle 12 may be longitudinally altered to facilitate adjustment of the size of receptacle 12 and, thereby, better accommodate various sizes of electronic devices. Alternatively, a hard, resilient member, such as a foam or rubber, may be disposed against retaining lip 24 for providing a minor variation in the size of receptacle 12.

Figure 7:
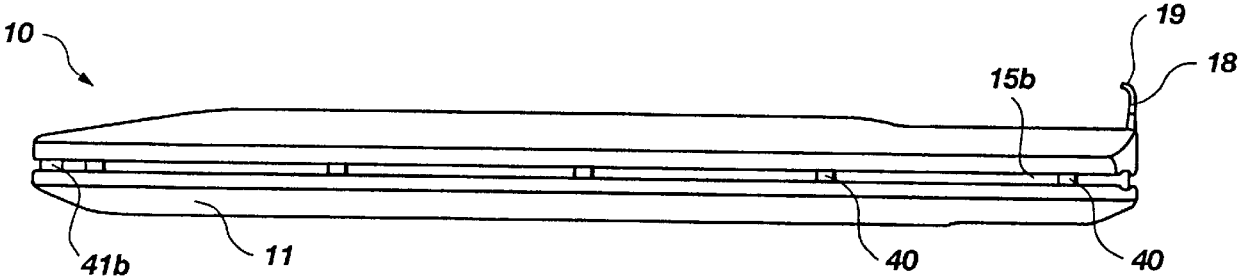
FIG. 7 is a plan view of a side peripheral edge of the apparatus shown in FIG. 1, illustrating a retaining slot into which an attachment member is insertable.

With reference to FIGS. 2 and 7, engagement clip 18 comprises at least a portion of edge 17*a* of receptacle 12. Engagement clip 18 preferably comprises a resilient member that includes a securing lip 19 at the top thereof. Securing lip 19 extends inwardly toward receptacle 12. When an electronic device 100 (see FIG. 1) is disposed within receptacle 12, securing lip 19 extends over an edge of electronic device 100 and partially over the face thereof, engaging and retaining the edge of the electronic device 100 to partially secure the electronic device within receptacle 12. Engagement clip 18 may slide longitudinally relative to receptacle 12 (i.e., up and down as seen in FIG. 2) to adjust the size of receptacle 12 and, thereby, better accommodate electronic devices of different sizes.

Figure 6:
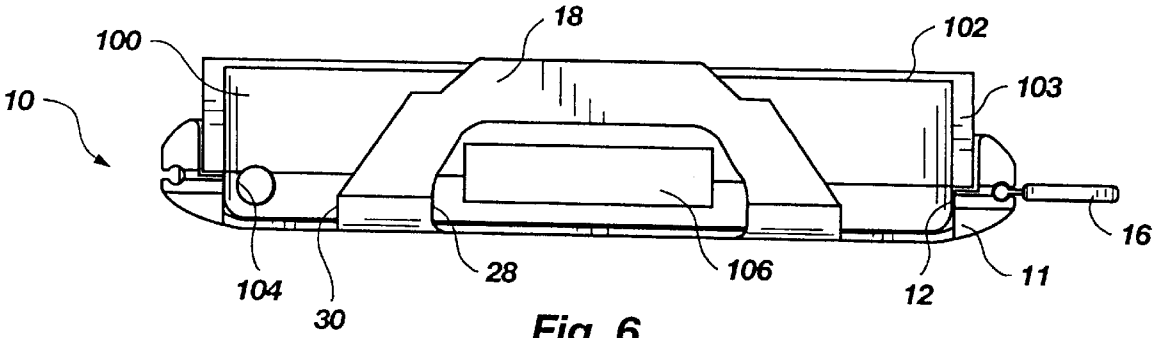
FIG. 6 is a plan view of a top peripheral edge of the apparatus shown in FIG. 2, which also illustrates a portion of the top peripheral edge of the electronic device disposed therein.

As depicted in FIG. 6, engagement clip 18 may include a window 28, which is also referred to as an access slot or an aperture, formed therethrough, through which electromagnetic radiation, such as infrared signals, may be transmitted. Accordingly, window 28 facilitates the transmission of signals to and from an infrared communication element 106 of electronic device 100 while the electronic device is disposed in receptacle 12. Alternatively, a window may be formed through a housing 11 or through another component of attachment apparatus 10 in order to facilitate the transmission of electromagnetic radiation or other communication signals to and from a differently positioned communication element of electronic device 100.

Figure 6A:
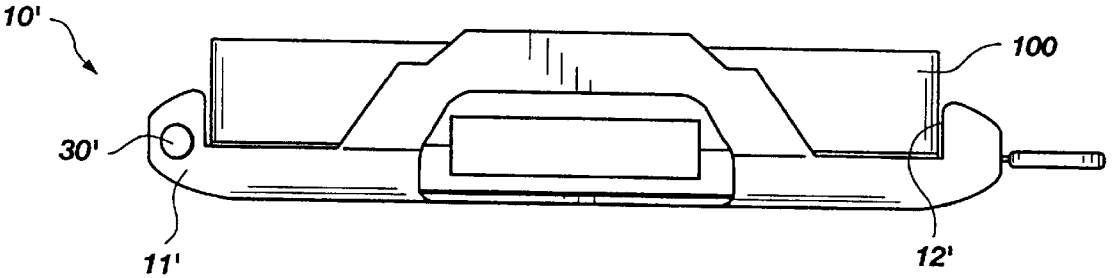
FIG. 6*a* is a plan view of a top peripheral edge of a variation of the apparatus shown in FIG. 1, which includes a stylus retaining slot formed in the housing thereof.

With continued reference to FIG. 6, one or more stylus insertion slots 30 may be located at the uppermost portion of receptacle 12. Stylus insertion slots 30 facilitate the insertion of a stylus through housing 11 and into a stylus retaining element 104 of an electronic device 100 secured within receptacle 12. Alternatively, as shown in FIG. 6*a*, in a variation of attachment apparatus 10', housing 11' may include a stylus receptacle 30' within which a stylus pen (not shown) may be disposed while an electronic device 100 is disposed within receptacle 12'.

Figure 5:
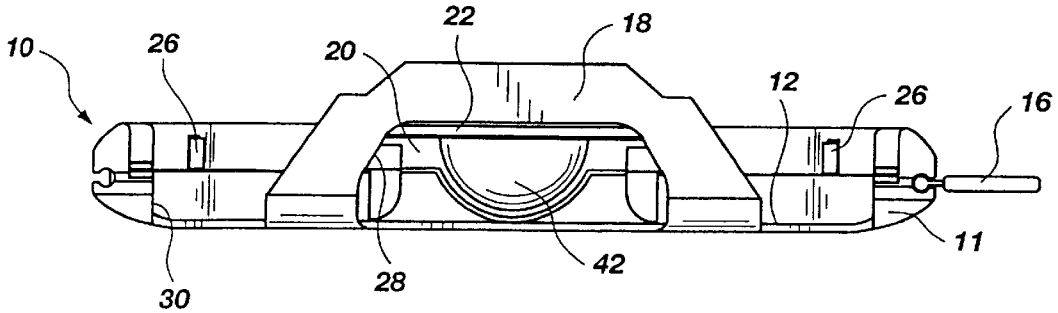
FIG. 5 is a plan view of a top peripheral edge of the apparatus shown in FIG. 1.
Figure 10:
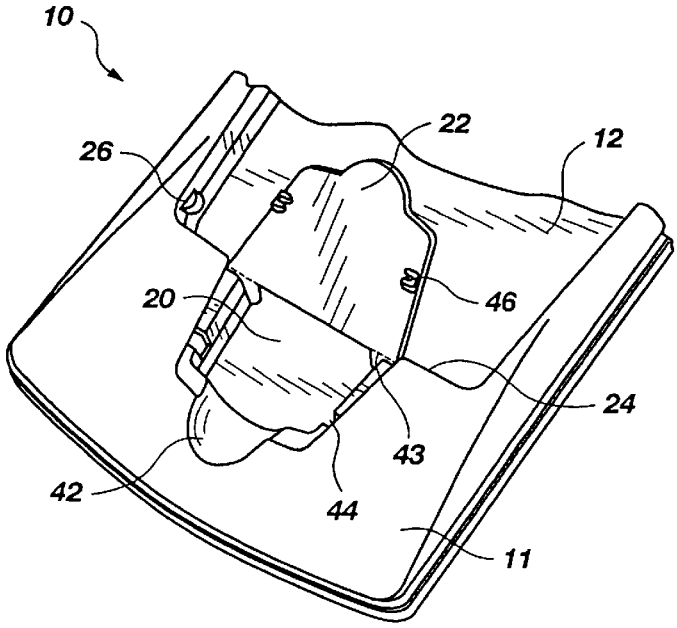
FIG. 10 is a partial frontal perspective view of an access port of the apparatus of FIG. 1, illustrating a cap component thereof in an open position.

Turning now to FIGS. 4, 5 and 10, one or more securing tabs 26 may protrude into receptacle 12, preferably near the bottom thereof. Securing tabs 26 each preferably comprise a resilient member and are configured to engage recesses (not shown) formed in a complementary location of electronic device 100. Accordingly, as electronic device 100 is properly oriented relative to receptacle 12 and disposed therein, securing tabs 26 are recessed into housing 11 until the corresponding recesses of the electronic device align therewith. As the corresponding recesses of the electronic device 100 and securing tabs 26 align, the resiliency of securing tabs 26 forces each of the securing tabs into their corresponding recess.

With continued reference to FIGS. 4, 5 and 10, attachment apparatus 10 may include an access portal 20, which is also referred to as an access slot, aperture or recess, that opens through the top of housing 11 into receptacle 12. Preferably, when an electronic device 100 (see FIG. 1) is disposed within receptacle 12, access portal 20 exposes a cable communication port (not shown) thereof. Access portal 20 may be specifically shaped to receive an adapter (not shown) of a communication cable (not shown) connectable to the communication port. Access portal 20 may include a recess 42 continuous therewith, which is adapted to receive the cable attached to the adapter. Recess 42 may also facilitate the removal or opening of a cap component 22 that is disposable over access portal 20.

Preferably, attachment apparatus 10 includes a cap component 22 that is disposable over access portal 20. Cap component 22 may include a hinge member 43 for securing the cap 22 to housing 11 and which facilitates the movement of cap 22 between open and closed positions to respectively expose and cover access portal 20. Hinge member 43 may be a relatively thin, pliable region of cap component 22 which extends thereacross and acts as a so-called "living hinge." Alternatively, hinge member 43 may be any other type of hinge known in the art that secures cap component 22 to housing 11 and facilitates the movement of cap component 22 between open and closed positions.

Cap component 22 may also include one or more retention clips 46 on a bottom surface thereof, each of which corresponds to a retention slot 44 formed in housing 11 adjacent access portal 20. Each retention clip 46 and its corresponding retention slot 44 are configured to mutually engage each other, such as in a snap-fit relationship, as cap component 22 is placed in a closed position over access portal 20. Other retention means known in the art may also be employed in the present invention to secure cap component 22 in a closed position over access portal 20.

With reference to FIGS. 4 and 7, the retaining slots 15*a* (shown in FIG. 4 only) and 15*b* of attachment apparatus 10 are illustrated. As shown in FIG. 4, retaining slots 15*a*, 15*b* each have a cross section complementary to that of a rib 36 disposed along an edge of attachment member 16 to facilitate the insertion and retention of rib 36 therein. Each retaining slot 15*a*, 15*b* preferably includes a stop 41*a* (see FIG. 4), 41*b* (see FIG. 7) at an end thereof, which ensures that rib 36 of attachment member 16 is inserted the appropriate distance into one of the retaining slots. One or more nodules 40 may be spaced apart along the length of each retaining slot 15*a*, 15*b* (see FIG. 7) and protrude partially thereinto.

Figure 8:
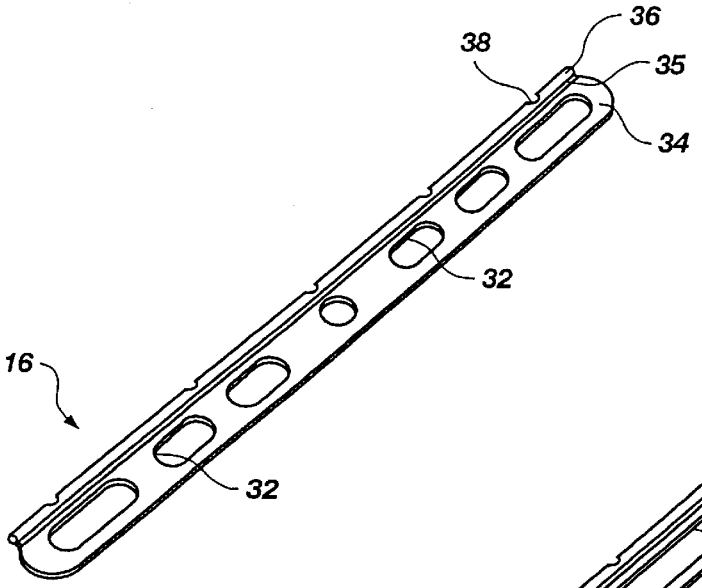
FIG. 8 is a perspective view of an attachment member that may be employed on the apparatus shown in FIGS. 1 and 2.

Referring to FIG. 8, attachment member 16 includes an enlarged rib 36 disposed along an elongated edge thereof and an attachment component 34 opposite the rib. Preferably, attachment member 16 also includes an elongated pliable component 35, which is typically referred to as a "living hinge", extending substantially along the length thereof and disposed between rib 36 and attachment component 34.

A series of apertures 32 formed through attachment component 34 facilitates attachment of attachment member 16, the remainder of attachment apparatus 10, and any electronic device 100 (see FIG. 1) secured to the attachment apparatus to the retaining element of a support assembly (not shown). Preferably, at least some apertures 32 are somewhat elongated to facilitate the engagement of attachment member 16 by various support assemblies having different numbers of retaining elements or retaining elements that are laterally spaced different distances from one another.

The rib 36 of attachment member 16 may include one or more notches 38 spaced laterally apart from one another along the peripheral side thereof. Notches 38 are shaped and positioned complementary to any nodules 40 that protrude into retaining slots 15*a* and 15*b*. Thus, as rib 36 is inserted longitudinally into one of retaining slots 15*a*, 15*b* (see FIG. 7), nodules 40 snap into notches 38, securing attachment member 16 to housing 11. Alternatively, rib 36 may be secured within a retaining slot 15*a*, 15*b* by interference fit, or any other means known in the art.

Figure 9:
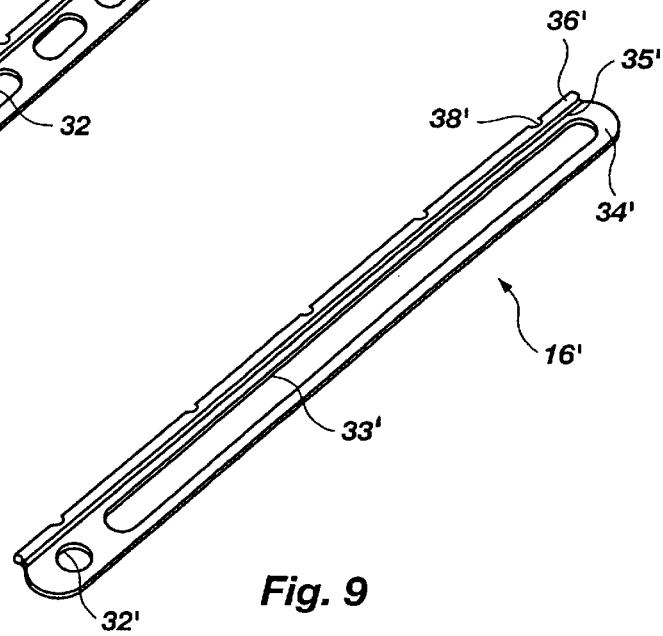
FIG. 9 is a perspective view of a variation of the attachment member shown in FIG. 8.

FIG. 9 illustrates a variation of attachment member 16', which includes a small, circular first aperture 32' and an elongated second aperture 33'. First aperture 32' and second aperture 33' facilitate the securing of attachment member 16' to a variety of support assemblies with different numbers of retaining elements and retaining elements which are laterally spaced different distances from one another. Other variations of the attachment member, as well as variations of the apertures thereof, may also be employed with attachment apparatus 10 (see FIGS. 1 and 2) of the present invention, such as those disclosed in U.S. Pat. No. 5,597,256, which issued to Burton et al. on Jan. 28, 1997, the disclosure of which is hereby incorporated by reference in its entirety.

Figure 11:
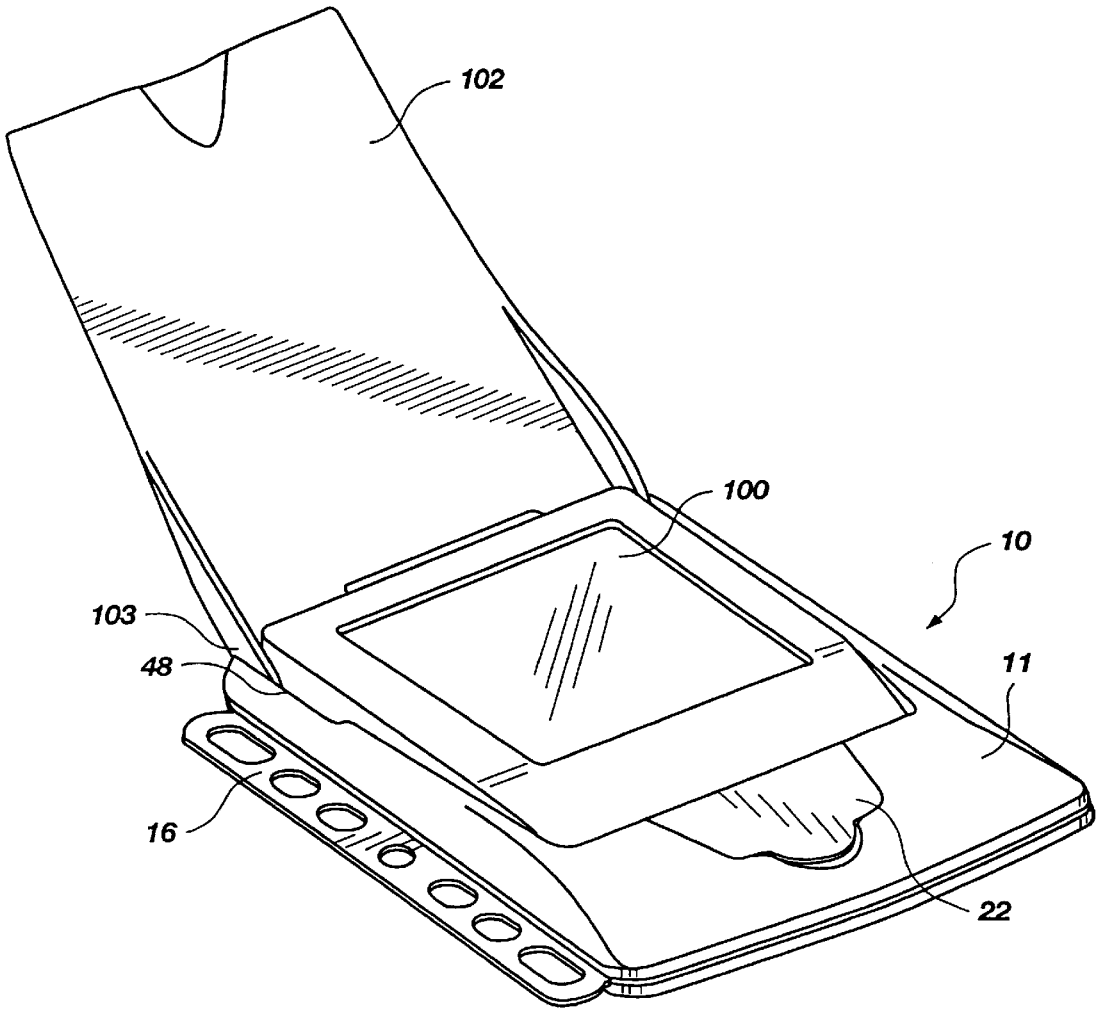
FIG. 11 is a frontal perspective view of the apparatus shown in FIG. 2, with a flip cover of the electronic device raised to an open position.

Referring now to FIG. 11, attachment apparatus 10 is illustrated with an electronic device 100 disposed in receptacle 12. Recesses 48, which are adjacent and continuous with receptacle 12, receive a flange 103 along the side of cover 102 of electronic device 100, and facilitate the placement of cover 102 of electronic device 100 in an open position. Thus, cover 102 may remain on electronic device 100 and the electronic device may be used when disposed within receptacle 12 of attachment apparatus 10.

Figure 12:
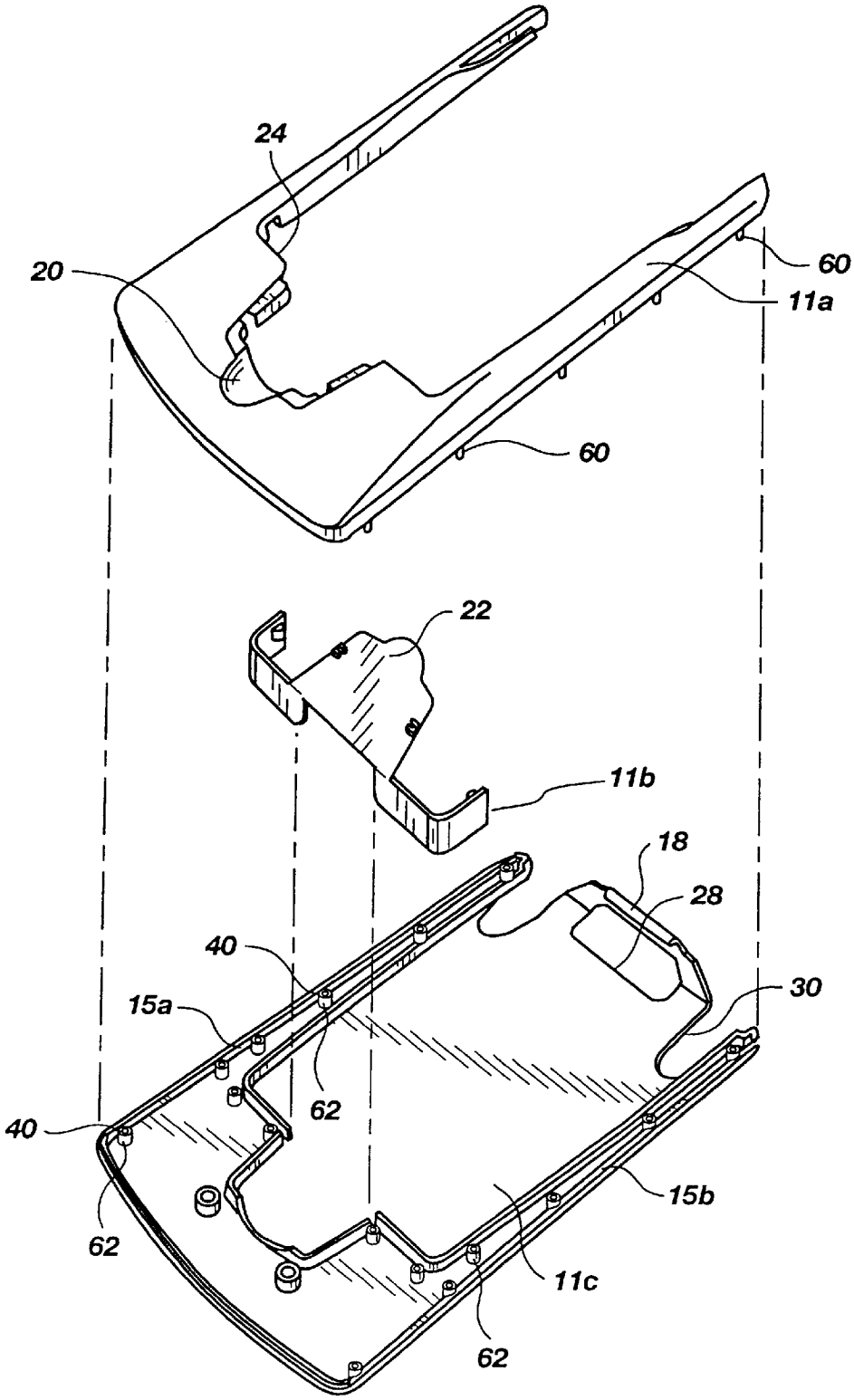
FIG. 12 is an exploded view of the apparatus shown in FIG. 1.

FIG. 12 is an exploded view of attachment apparatus 10, which illustrates the various elements of housing 11 and a preferred embodiment of the manner in which these elements are assembled. Housing 11 includes an upper element 11*a*, a middle element 11*b*, and a lower element 11*c*. Upper element 11*a* and lower element 11*c* are secured to one another by means of complementary pins 60 and receptacles 62. During the assembly of upper element 11*a*, middle element 11*b*, and lower element 11*c*, middle element 11*b* is disposed between upper element 11*a* and lower element 11*c*, each of the elements are aligned, and middle element 11*b* is secured between the upper and lower elements as the corresponding pins 60 and receptacles 62 of the upper and lower elements are interconnected.

Upon interconnecting the corresponding sets of pins 60 and receptacles 62 of upper element 11*a* and lower element 11*c*, each corresponding pin 60 and receptacle 62 set that is located adjacent retaining slots 15*a* and 15*b* comprises a nodule 40.

Referring again to FIGS. 1 and 2, a preferred embodiment of a method of securing an electronic device 100 to attachment apparatus 10 is depicted. A lower peripheral edge of electronic device 100 is aligned with retaining lip 24 and inserted into receptacle 12 so that retaining lip 24 engages the lower peripheral edge. Engagement clip 18 is biased laterally upward relative to receptacle 12 so as to permit movement of the electronic device 100 past securing lip 19 and thereby facilitate placement of electronic device 100 in receptacle 12. Upon releasing engagement clip 18, the resilience thereof facilitates positioning of the securing lip 19 over an upper peripheral edge of electronic device 100, thereby securing electronic device 100 within receptacle 12.

Electronic device 100 may be similarly removed from receptacle 12 of attachment apparatus 10 by biasing engagement clip 18 away from electronic device 100 and forcing electronic device 100 out of receptacle 12.

The method of securing electronic device 100 to attachment apparatus 10 may also include biasing securing tabs 26 toward or into housing 11 as electronic device 100 is placed in receptacle 12. When securing tabs 26 and their corresponding receptacles or slots on electronic device 100 are aligned, the resilience of securing tabs 26 facilitates their engagement of the corresponding receptacles or slots.

Figure 13:
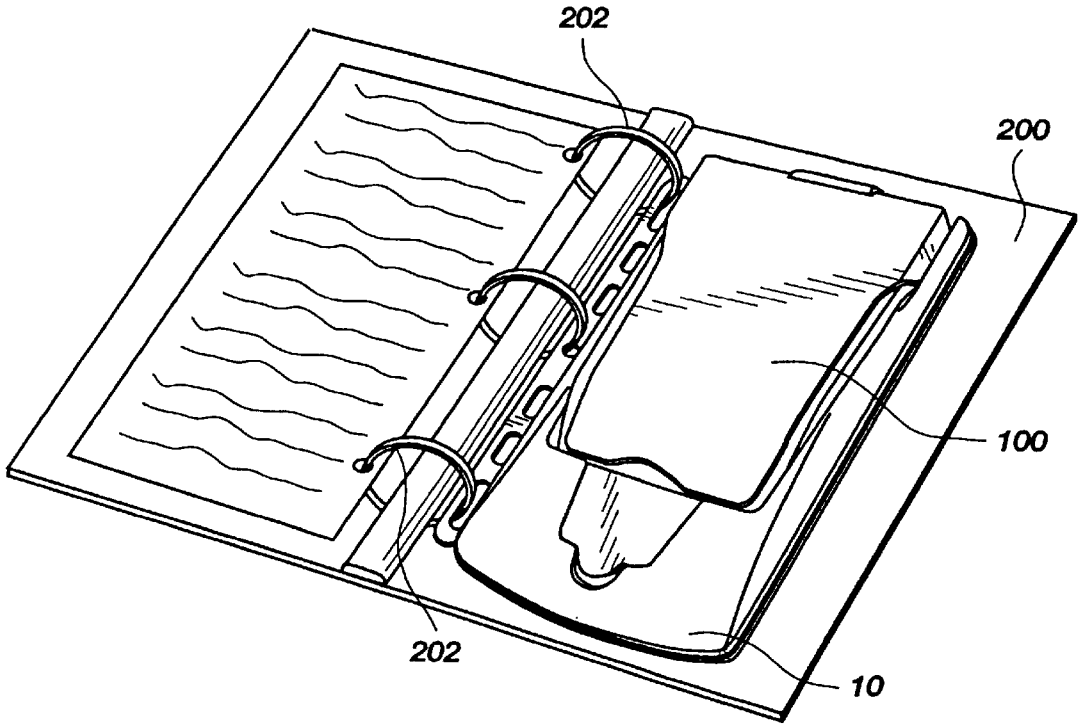
FIG. 13 is a schematic representation of the apparatus shown in FIG. 1 attached to the retaining elements of a loose-leaf support assembly.

Referring now to FIG. 13, attachment apparatus 10 may be secured to the laterally spaced apart rings 202 of a notebook 200 by opening rings 202, inserting rings 202 through apertures 32 of attachment member 16, and closing rings 202.

Although the foregoing description contains many specifics, these should not be construed as limiting the scope of the present invention, but merely as providing illustrations of some of the presently preferred embodiments. Similarly, other embodiments of the invention may be devised which do not depart from the spirit or scope of the present invention. Features may be employed alone or in various combinations. The scope of this invention is, therefore, indicated and limited only by the appended claims and their legal equivalents, rather than by the foregoing description. All additions, deletions and modifications to the invention as disclosed herein which fall within the meaning and scope of the claims are to be embraced thereby.

What is claimed is:

1. An apparatus for securing an electronic device to a loose-leaf support assembly, comprising:

a housing including a member extending therefrom;

a receptacle defined by said housing; and a capture element adjacent said receptacle and including said member at one edge of said receptacle and configured to bias the electronic device against another, opposite edge of said receptacle so as to secure one edge of the electronic device with said capture element and an opposite edge of the electronic device with said opposite edge said receptacle.

2. The apparatus of claim 1, further comprising an attachment member disposable adjacent at least one peripheral edge of said housing and securable to a retainer of the loose-leaf support assembly.

3. The apparatus of claim 2, wherein said attachment member comprises at least one aperture formed therethrough.

4. The apparatus of claim 3, wherein said at least one aperture comprises an elongated slot.

5. The apparatus of claim 2, wherein said attachment member is removably securable to at least one peripheral edge of said housing.

6. The apparatus of claim 2, wherein said housing comprises at least one retaining slot adjacent a peripheral edge thereof.

7. The apparatus of claim 6, wherein said retaining slot is configured to receive said attachment member.

8. The apparatus of claim 6, further comprising at least one nodule on said housing protruding into said at least one retaining slot.

9. The apparatus of claim 8, wherein said attachment member includes at least one notch for engaging said at least one nodule.

10. The apparatus of claim 1, wherein said opposite edge comprises at least one recess therein.

11. The apparatus of claim 1, wherein said capture element is resilient.

12. The apparatus of claim 1, wherein said capture element comprises a lip configured to extend at least partially over and substantially parallel to a face of the electronic device.

13. The apparatus of claim 1, further comprising at least one aperture formed through said housing, said at least one aperture located so as to align with a remote communication component of the electronic device upon positioning the electronic device within said receptacle.

14. The apparatus of claim 1, further comprising an elongated, substantially cylindrical receptacle formed in said housing.

15. The apparatus of claim 1, further comprising at least one tab protruding into said receptacle, said at least one tab being located and configured to engage a corresponding recess formed in the electronic device upon positioning the electronic device within said receptacle.

16. The apparatus of claim 15, wherein said at least one tab protrudes from a peripheral edge of said receptacle.

17. The apparatus of claim 15, wherein said at least one tab protrudes from said opposite edge.

18. The apparatus of claim 15, wherein said at least one tab is recessible into said housing.

19. The apparatus of claim 13, wherein said at least one aperture comprises an access portal configured to receive an adapter of a cable-type connector.

20. The apparatus of claim 19, further comprising a cap component disposable over said access portal.

21. The apparatus of claim 1, wherein said receptacle comprises a substantially rectangular shape.

22. An insert attachable to a retainer element of a support assembly, comprising:

a housing including:

a receptacle with at least one substantially upwardly extending edge configured complementarily to a corresponding edge of an electronic device to be inserted in said receptacle so as to retain the corresponding edge of the electronic device, said receptacle also including an open peripheral portion;

a resilient capture element positioned adjacent said open peripheral portion, said resilient capture element being laterally separate from said at least one substantially upwardly extending edge and configured to bias the corresponding edge of the electronic device against said at least one substantially upwardly extending edge of said receptacle; and at least one retaining slot formed in a peripheral edge of said housing; and an attachment member insertable into said at least one retaining slot and securable to the retainer element of the support assembly.

23. The insert of claim 22, wherein said attachment member comprises at least one aperture formed therethrough and securable to the retainer element.

24. The insert of claim 23, wherein said at least one aperture comprises an elongated slot.

25. The insert of claim 22, wherein said housing further includes at least one nodule protruding into said at least one retaining slot.

26. The insert of claim 25, wherein said attachment member comprises at least one notch positioned complementary to said at least one nodule.

27. The insert of claim 22, wherein said resilient capture element is located opposite said at least one substantially upwardly extending edge of said receptacle.

28. The apparatus of claim 1, wherein said capture element is configured to be moved away from said receptacle so as to facilitate placement of the electronic device within the receptacle.

29. The apparatus of claim 1, wherein at least a portion of said opposite edge of said receptacle is configured complementarily to a corresponding portion of said one edge of the electronic device.

30. The apparatus of claim 12, wherein said lip is configured to contact said face of the electronic device.

31. The insert of claim 20, further comprising at least one tab protruding into said receptacle, said at least one tab being located and configured to engage a corresponding recess formed in the electronic device upon positioning the electronic device within said receptacle.

32. The insert of claim 31, wherein said at least one tab protrudes from a peripheral edge of said receptacle.

33. The insert of claim 31, wherein said at least one tab is recessible into said housing.

* * * * *